US010196580B2

(12) United States Patent
Zhang et al.

(10) Patent No.: US 10,196,580 B2
(45) Date of Patent: Feb. 5, 2019

(54) LUBRICATING COMPOSITION WITH SEALS COMPATIBILITY

(71) Applicant: The Lubrizol Corporation, Wickliffe, OH (US)

(72) Inventors: Yanshi Zhang, Solon, OH (US); Jason J. Hanthorn, Eastlake, OH (US); Ewan E. Delbridge, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 57 days.

(21) Appl. No.: 15/506,442

(22) PCT Filed: Aug. 28, 2015

(86) PCT No.: PCT/US2015/047322

§ 371 (c)(1),
(2) Date: Feb. 24, 2017

(87) PCT Pub. No.: WO2016/033397

PCT Pub. Date: Mar. 3, 2016

(65) Prior Publication Data

US 2018/0223216 A1 Aug. 9, 2018

Related U.S. Application Data

(60) Provisional application No. 62/042,861, filed on Aug. 28, 2014.

(51) Int. Cl.

| | |
|---|---|
| ***C10M 141/00*** | (2006.01) |
| ***C10M 169/04*** | (2006.01) |
| ***C10M 141/06*** | (2006.01) |
| ***C10M 171/02*** | (2006.01) |
| *C10M 129/68* | (2006.01) |
| *C10M 129/72* | (2006.01) |
| *C10M 129/24* | (2006.01) |
| *C10M 129/00* | (2006.01) |

(52) U.S. Cl.

CPC ..... *C10M 141/06* (2013.01); *C10M 169/04* (2013.01); *C10M 171/02* (2013.01); *C10M 129/00* (2013.01); *C10M 129/24* (2013.01); *C10M 129/68* (2013.01); *C10M 129/72* (2013.01); *C10M 141/00* (2013.01); *C10M 2203/1025* (2013.01); *C10M 2205/022* (2013.01); *C10M 2205/024* (2013.01); *C10M 2205/026* (2013.01); *C10M 2207/026* (2013.01); *C10M 2207/028* (2013.01); *C10M 2207/044* (2013.01); *C10M 2207/26* (2013.01); *C10M 2207/262* (2013.01); *C10M 2207/282* (2013.01); *C10M 2215/06* (2013.01); *C10M 2215/064* (2013.01); *C10M 2215/066* (2013.01); *C10M 2215/221* (2013.01); *C10M 2215/28* (2013.01); *C10M 2219/022* (2013.01); *C10M 2219/046* (2013.01); *C10M 2219/089* (2013.01); *C10M 2223/045* (2013.01); *C10N 2210/02* (2013.01); *C10N 2220/021* (2013.01); *C10N 2230/02* (2013.01); *C10N 2230/04* (2013.01); *C10N 2230/08* (2013.01); *C10N 2230/12* (2013.01); *C10N 2230/36* (2013.01); *C10N 2230/42* (2013.01); *C10N 2230/43* (2013.01); *C10N 2230/45* (2013.01); *C10N 2230/52* (2013.01); *C10N 2240/10* (2013.01); *C10N 2240/103* (2013.01); *C10N 2240/104* (2013.01); *C10N 2260/14* (2013.01)

(58) Field of Classification Search

CPC ..... C10M 141/06; C10M 171/02; C10M 2223/045; C10M 2219/089; C10M 2219/046; C10M 2215/221; C10M 2215/066; C10M 2207/282; C10M 2207/262; C10M 2207/044; C10M 2207/026; C10M 2205/026; C10M 2203/1025; C10M 2215/28; C10N 2230/36; C10N 2230/04; C10N 2230/02; C10N 2220/021; C10N 2210/02; C10N 2230/52; C10N 2240/10

See application file for complete search history.

(56) References Cited

U.S. PATENT DOCUMENTS

| | | | | |
|---|---|---|---|---|
| 2,312,743 | A * | 3/1943 | Arundale | C07D 319/06 549/372 |
| 3,248,327 | A | 4/1966 | Whitaker | |
| 5,380,853 | A * | 1/1995 | Fobare | C07D 319/06 546/207 |
| 6,297,410 | B1 | 10/2001 | Fortunak | |
| 2010/0256029 | A1 | 10/2010 | Elvidge | |
| 2011/0034357 | A1* | 2/2011 | Kawata | C10M 169/04 508/202 |
| 2011/0287993 | A1* | 11/2011 | Shibata | C10M 105/12 508/583 |

FOREIGN PATENT DOCUMENTS

WO 2014/088814 A1 6/2014

* cited by examiner

*Primary Examiner* — Taiwo Oladapo
(74) *Attorney, Agent, or Firm* — Michael Miller

(57) ABSTRACT

The disclosed technology relates to a lubricating composition additives that prevent or reduce seals degradation, especially in the presence of basic amine compounds which impart basicity (measured as total base number or TBN) to the lubricating composition. The lubricating composition contains (a) an oil of lubricating viscosity, (b) a basic amine compound, and (c) a 1,3-dioxane-4,6-dione compound.

18 Claims, No Drawings

LUBRICATING COMPOSITION WITH SEALS COMPATIBILITY

CROSS REFERENCE TO RELATED APPLICATION

This application claims priority from PCT Application Serial No. PCT/US2015/047322 filed on Aug. 28, 2015, which claims the benefit of U.S. Provisional Application No. 62/042,861 filed on Aug. 28, 2014.

FIELD OF DISCLOSED TECHNOLOGY

The disclosed technology relates to lubricating composition additives that prevent or reduce seals degradation, especially in the presence of basic amine compounds which impart basicity (measured as total base number or TBN) to the lubricating composition. The additives typically do not lead to an increase in corrosion.

BACKGROUND OF THE DISCLOSED TECHNOLOGY

It is known that lubricating compositions become less effective during their use due to exposure to the operating conditions of the device they are used in, and particularly due to exposure to by-products generated by the operation of the device. For example, engine oil becomes less effective during its use, in part due to exposure of the oil to acidic and pro-oxidant by-products. These by-products result from the incomplete combustion of fuel in devices such as internal combustion engines, which utilize the oil. These by-products lead to deleterious effects in the engine oil and likewise in the engine. The by-products may, for example, oxidize hydrocarbons found in the lubricating oil, yielding carboxylic acids and other oxygenates. These oxidized and acidic hydrocarbons can then go on to cause corrosion, wear and deposit problems.

Base-containing additives are added to lubricating compositions in order to neutralize such by-products, thus reducing the harm they cause to the lubricating composition and to the device. Over-based calcium or magnesium carbonate detergents have been used for some time as acid scavengers, neutralizing these by-products and so protecting both the lubricating composition and the device. However, over-based detergents carry with them an abundance of metal as measured by sulfated ash. Industry upgrades for diesel and passenger car lubricating oils are putting ever decreasing limits on the amount of sulfated ash, and by extension the amount of over-based detergent, permissible in an oil. Therefore, a source of base that consists of only N, C, H, and O atoms is extremely desirable.

There are two common measures of basicity that are used in the field of lubricating composition additives. Total Base Number (TBN) may be as measured by ASTM D2896, which is a titration that measures both strong and weak bases. On the other hand, ASTM D4739 is a titration that measures strong bases but does not readily titrate weak bases such as certain amines, including many aromatic amines. Many lubricating composition applications desire TBN as measured by ASTM D4739, making many amines less than satisfactory sources of basicity. As used herein, TBN (total base number) values are measured by the methodology described in ASTM D2896 unless otherwise specifically noted.

Basic amine additives have nevertheless been investigated as alternatives to ash containing over-based metal detergents, for example, alkyl and aromatic amines. However, the addition of basic amine additives can lead to additional detrimental effects. For example, it is known that alkyl and some aromatic amines tend to degrade fluoroelastomeric seals materials. These basic amine additives, such as succinimide dispersants, contain polyamine groups, which provide a source of basicity. However, such amines are believed to cause dehydrofluorination in fluoroelastomeric seals materials, such as Viton® seals, which is believed to be a first step in seals degradation. Seal degradation may lead to seal failure, such as seal leaks, harming engine performance and possibly causing engine damage. Generally, the base content, or total base number (TBN), of a lubricating composition can only be boosted modestly by such a basic amine before seals degradation becomes a significant issue, limiting the amount of TBN that can be provided by such additives.

SUMMARY OF THE DISCLOSED TECHNOLOGY

The disclosed technology, may solve the problem of providing strong basicity, as measured by ASTM D4739, to a lubricating composition, without imparting additional metal content (sulfated ash) thereto and while not leading to deterioration of elastomeric seals. For example, seal compatibility may be measured by the Mercedes Benz supply specification MB DBL6674 FKM.

As used herein, reference to the amounts of additives present in the lubricating composition disclosed are quoted on an oil free basis, i.e., amount of actives, unless otherwise indicated.

As used herein, the transitional term "comprising," which is synonymous with "including", "containing", or "characterized by", is inclusive or open-ended and does not exclude additional, un-recited elements or method steps. However, in each recitation of "comprising" herein, it is intended that the term also encompass, as alternative embodiments, the phrases "consisting essentially of" and "consisting of", where "consisting of" excludes any element or step not specified and "consisting essentially of" permits the inclusion of additional un-recited elements or steps that do not materially affect the basic and novel characteristics of the composition or method under consideration.

The disclosed technology provides a lubricating composition comprising (a) an oil of lubricating viscosity; (b) a basic amine compound, and (c) a 1,3-dioxane-4,6-dione compound.

Typically the 1,3-dioxane-4,6-dione does not deplete the TBN of the basic amine compound.

The disclosed technology may provide a lubricating composition comprising (a) an oil of lubricating viscosity; (b) 0.01 wt % to 5 wt % of a 1,3-dioxane-4,6-dione compound; and (c) 0.1 wt % to 10 wt % of a basic amine compound.

The disclosed technology may provide a lubricating composition comprising (a) an oil of lubricating viscosity; (b) 0.01 wt % to 5 wt % of a 1,3-dioxane-4,6-dione compound; and (c) 0.1 wt % to 10 wt % of an aromatic basic amine compound, or mixtures thereof.

The disclosed technology may provide a lubricating composition comprising (a) an oil of lubricating viscosity; (b) 0.01 wt % to 5 wt % of a 1,3-dioxane-4,6-dione compound; and (c) 0.1 wt % to 10 wt % of a basic amine compound, wherein the basic amine compound comprises a diarylamine.

The disclosed technology may provide a lubricating composition comprising (a) an oil of lubricating viscosity; (b)

0.01 wt % to 5 wt % of a 1,3-dioxane-4,6-dione compound; and (c) 0.1 wt % to 10 wt % of an aromatic basic amine compound, wherein the basic amine compound comprises a phenylene diamine.

The disclosed technology may provide a lubricating composition comprising (a) an oil of lubricating viscosity; (b) 0.01 wt % to 5 wt % of a 1,3-dioxane-4,6-dione compound; and (c) 0.1 wt % to 10 wt % of an aromatic basic amine compound chosen from a pyridine or substituted pyridine compound.

The lubricating composition of the disclosed technology may further comprise a polyisobutylene succinimide dispersant.

The disclosed technology may provide a lubricating composition comprising (a) an oil of lubricating viscosity; (b) 0.01 wt % to 5 wt % of a 1,3-dioxane-4,6-dione compound; and (c) 0.1 wt % to 10 wt % of a basic amine compound, wherein the basic amine compound comprises an N-hydrocarbyl substituted aminoester compound.

The basic amine compound may be present at 0.3 wt % to 5 wt %; and the 1,3-dioxane-4,6-dione compound may be present at 0.3 wt % to 4 wt %.

The basic amine compound may be present at 0.3 wt % to 5 wt %; and the 1,3-dioxane-4,6-dione compound may be present at 0.5 wt % to 2 wt %.

The basic amine compound may be present at 1 wt % to 3 wt %; and the 1,3-dioxane-4,6-dione compound may be present at 0.5 wt % to 2 wt %.

The disclosed technology may provide a lubricating composition comprising (a) an oil of lubricating viscosity; (b) 0.01 wt % to 5 wt % of a 1,3-dioxane-4,6-dione compound; and (c) 0.1 wt % to 10 wt % of a basic amine compound, wherein the basic amine compound comprises a polyisobutylene succinimide dispersant.

The lubricating composition of the disclosed technology may further comprise a zinc dialkyldithiophosphate.

The lubricating composition of the disclosed technology may further comprise a polyisobutylene succinimide dispersant and a zinc dialkyldithiophosphate.

The lubricating composition of the disclosed technology may further comprise a polyisobutylene succinimide dispersant, a diarylamine, and a zinc dialkyldithiophosphate.

The basic amine compound may comprise a primary amine, a secondary amine, or mixtures thereof and may be present in an amount to provide a TBN value of at least 1 mg KOH/g as measured by ASTM D2896 to the lubricating composition. The basic amine compound may be a dispersant, but is typically different from a dispersant.

The basic amine compound may be a compound chosen from a phenylene diamine, diarylamine pyridine or substituted pyridine compound. The basic amine compound may have a molecular weight of less than 1000 g $mol^{-1}$, or 31 to 500, or 150 to 450 g $mol^{-1}$.

The disclosed technology may provide a lubricating composition characterized as having (i) a sulfur content of 0.5 wt % or less, (ii) a phosphorus content of 0.1 wt % or less, and (iii) a sulfated ash content of 0.5 wt % to 1.5 wt % or less.

The lubricating composition may have a SAE viscosity grade of XW—Y, wherein X may be 0, 5, 10, or 15; and Y may be 16, 20, 30, or 40.

The oil of lubricating viscosity may comprise an API Group I, II, III, IV, V base oil, or mixtures thereof (typically API Group I, II, III, IV, or mixtures thereof).

In one embodiment the disclosed technology provides a method of lubricating an internal combustion engine comprising supplying to the internal combustion engine a lubricating composition disclosed herein.

The internal combustion engine may have a steel surface on a cylinder bore, a cylinder block, or a piston ring.

The internal combustion engine may be spark ignition or compression ignition. The internal combustion engine may be a 2-stroke or 4-stroke engine. The internal combustion engine may be a passenger car engine, a light duty diesel engine, a heavy duty diesel engine, a motorcycle engine, or a 2-stroke or 4-stroke marine diesel engine. Typically the internal combustion engine may be a passenger car engine, or a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

The disclosed technology further provides a method for improving the seal compatibility of an engine oil composition which comprises an oil of lubricating viscosity and a basic amine compound, wherein the basic amine compound has a TBN of at least 50 mg KOH/g, said method comprising addition of a 1,3-dioxane-4,6-dione compound as detailed herein to the composition.

The disclosed technology further provides a method for improving the seal compatibility of an engine oil composition which comprises an oil of lubricating viscosity, a 1,3-dioxane-4,6-dione compound, and a basic amine compound, wherein the composition has less than 1.0 wt % sulfated ash and a TBN of at least 7 mg KOH/g.

In one embodiment the disclosed technology provides for the use of a mixture of a 1,3-dioxane-4,6-dione compound, and a basic amine compound in a lubricating composition to improve seal compatibility (typically not leading to deterioration of elastomeric seals) in an internal combustion engine. The improvement may be measured for example by evaluating seal compatibility in the Mercedes Benz supply specification MB DBL6674 FKM.

DETAILED DESCRIPTION OF THE DISCLOSED TECHNOLOGY

The present disclosed technology provides a lubricant composition, a method for lubricating a mechanical device and the use as disclosed above.

Dioxane-Dione Compound

In one embodiment, the 1,3-dioxane-4,6-dione compound may be represented by the formula

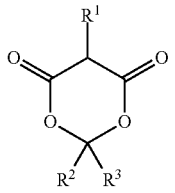

wherein $R^1$ may be hydrogen or a hydrocarbyl group of 1 to 12 carbon atoms, or 1 to 8 carbon atoms, or 1 to 4 carbon atoms; and $R^2$ and $R^3$ are independently hydrogen or hydrocarbyl groups of 1 to 20 carbon atoms, or 1 to 12 carbon atoms, or 1 to 8 carbon atoms, or 1 to 4 carbon atoms.

In one embodiment, the 1,3-dioxane-4,6-dione compound may be 2,2-dimethyl-1,3-dioxane-4,6-dione, also referred to as malonic acid cyclic isopropylidene ester and cycl-isopropylidene malonate. In one embodiment, 2,2-dimethyl-1,3-dioxane-4,6-dione may be represented by the formula

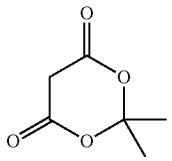

In certain embodiments, the 1,3-dioxane-4,6-dione compound may be present in a lubricating composition in an amount 0.1 wt % to 5 wt %, or 0.3 wt % to 4 wt %, or 0.5 wt % to 3.5 wt %, or 1 wt % to 3 wt %, or 0.5 wt % to 2 wt % of the lubricating composition.

Basic Amine Compound

The lubricating composition will also include at least one basic amine compound. The amine compound is a non-metal containing additive. A non-metal containing additive may also be referred to as an ashless (or ash-free) additive, since it will typically not produce any sulfated ash when subjected to the conditions of ASTM D 874. An additive is referred to as "non-metal containing" if it does not contribute metal content to the lubricating composition. The non-metal containing basic amine compound comprises a nitrogen-containing additive or TBN booster having a total base number (always expressed herein on a neat chemical basis, that is, without the diluent oil that is conventionally present) of at least 50 mg KOH/g or alternatively at least 70 mg KOH/g. In certain embodiments, the basic amine compound may have a TBN of 50 to 250 mg KOH/g or 70 to 200 mg KOH/g or 95 to 170 mg KOH/g.

In certain embodiments, the basic amine compound may be an aliphatic amine compound or an aromatic amine compound, or mixtures thereof. An aliphatic or aromatic amine compound is intended to describe the hydrocarbyl group(s) to which the basic nitrogen (i.e. aminic nitrogen) is directly attached. It is recognized that an aliphatic amine may contain aromatic moieties elsewhere in the molecule, and likewise an aromatic amine may contain some aliphatic content.

The amine compound of the disclosed technology may comprise nitrogen-containing dispersants. This is because the material will formally have the structure of a dispersant, which is a polar, nitrogen-containing "head" and a non-polar, hydro-carbonaceous "tail". In order to most effectively function as a dispersant, that is, to aid in dispersing products of combustion or other contaminants within a lubricating composition, it will normally be desirable to properly determine and balance the nature and chain lengths of the head and tail portions. However, in the disclosed technology, the materials in question need not always be designed to provide optimum dispersancy. That is, they may also be designed primarily to provide additional basicity to the formulation (measured as TBN, total base number as measured by ASTM D2896), and such materials may equally be described then, as TBN boosters. All such materials are intended to be included within the scope of this component of the disclosed technology, and references herein to "the high TBN dispersant" should be so understood. Dispersants are described in more detail herein below.

In certain embodiments, the basic amine compound may be a succinimide dispersant. The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetraethylenepentamine, pentaethylene-hexamine, polyamine still bottoms, and mixtures thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. The high TBN nitrogen-containing dispersant, particularly when it is a succinimide dispersant, may have an N:CO ratio of greater than 1.6:1. That is, there may be more than 1.6 nitrogen atoms in the dispersant (particularly those nitrogen atoms associated with an amide or imide function) for each carbonyl group in the dispersant. Suitable N:CO ratios include 1.6:1 to 2.2:1 or 1.7:1 to 2.1:1 or about 1.8:1.

In certain embodiments, the basic amine compound that delivers TBN to the lubricating composition is other than a nitrogen-containing dispersant.

In certain embodiments, the basic amine compound may be an aliphatic hydrocarbyl amine compound. The aliphatic hydrocarbyl amine may be a primary amine, a secondary amine, a tertiary amine, or mixtures thereof. Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine.

Examples of suitable secondary amines include dimethylamine, diethylamine, dipropylamine, dibutylamine, diamylamine, dihexylamine, diheptylamine, methylethylamine, ethylbutylamine, bis(2-ethylhexyl)amine, N-methyl-1-amino-cyclo-hexane, and ethylamylamine. The secondary amines may be cyclic amines such as piperidine, piperazine and morpholine. Examples of tertiary amines include tri-n-butylamine, tri-n-octylamine, tri-decylamine, tri-laurylamine, tri-hexadecylamine, tris(2-ethylhexyl)amine, and dimethyl-oleylamine.

In certain embodiments, the basic amine compound may be an N-hydrocarbyl substituted aminoester compound, or mixtures thereof. The aminoester may comprise a N-hydrocarbyl-substituted gamma-aminoester, a N-hydrocarbyl beta-aminoester, or a N-hydrocarbyl delta-aminoester. The ester functionality may comprise an alcohol-derived group which is a hydrocarbyl group having 1 to about 30 carbon atoms. In one embodiment the aminoester may have a N-hydrocarbyl substituent that comprises a hydrocarbyl group of at least 3 carbons atoms, with a branch at the 1 or 2 position of the hydrocarbyl group, provided that if the ester or thioester is a methyl ester or methyl thioester then the hydrocarbyl group has a branch at the 1 position, and further provided that the hydrocarbyl group is not a tertiary group of an N-hydrocarbyl-substituted aminoester.

The substituted γ-aminoester may be generally depicted as a material represented by the formula

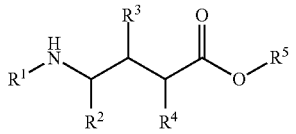

where $R^1$ may be a branched or linear hydrocarbyl substituent containing 1 to 32 carbon atoms, or 3 to 24 carbon atoms, or 5 to 14 carbon atoms; $R^2$ and $R^3$ may be hydrogen or hydrocarbyl groups of 1 to 8 carbon atoms; $R^4$ may be hydrogen, a hydrocarbyl group of 1 to 8 carbon atoms, or —$CH_2CO_2R^5$; and $R^5$ may be a hydrocarbyl group of 1 to 24 carbon atoms or an alkylene polyether group. In one embodiment, $R^1$ may be a hydrocarbyl group of at least 3 carbons atoms, with a branch at the 1 or 2 position of the hydrocarbyl group.

In certain embodiments, the γ-aminoester compound may have additional substituents or groups at the α, β, or γ positions (relative to the carboxylic acid moiety). In one embodiment there are no such substituents. In another embodiment there may be a substituent at the β position (i.e. $R^3$ in the formula above); this substituent may be a hydrocarbyl group of 1 to 8 carbon atoms or a group represented by —C(=O)—$R^6$ where $R^6$ may be hydrogen, an alkyl group, or —X'—$R^7$, where X' may be O or S and $R^7$ may be a hydrocarbyl group of 1 to 24 carbon atoms. When $R^3$ is —C(=O)—$R^6$, the structure may be represented by

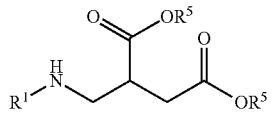

where $R^1$ may be a branched or linear hydrocarbyl substituent containing 1 to 32 carbon atoms, or 3 to 24 carbon atoms, or 5 to 14 carbon atoms; and $R^5$ may be a hydrocarbyl group of 1 to 24 carbon atoms or an alkylene polyether group. In an embodiment, the hydrocarbyl substituent $R^1$ on the amine nitrogen may comprise a hydrocarbyl group of at least 3 carbon atoms with a branch at the 1 or 2 (that is, a or (3) position of the hydrocarbyl chain.

In certain embodiments, the basic amine compound may be an aromatic amine compound. An aromatic amine may be characterized such that the basic nitrogen is attached directly to at least one aromatic (i.e. aryl) group that may be further substituted. The aromatic amine may be a primary amine, a secondary amine, a tertiary amine, or mixtures thereof, wherein at least one of the hydrocarbyl groups is an aryl group. Examples of suitable primary aromatic amines include aniline, anthranilic acid decyl ester (i.e. decylanthranilate), and p-ethoxyaniline (i.e. p-phenetidine). Examples of suitable secondary aromatic amines include diphenylamine, alkylated diphenylamine, phenyl-α-naphthylamine, alkylated phenyl-α-naphthylamine, N-methylaniline, and N-ethylaniline, The aromatic amine may be a diarylamine compound represented by the formula

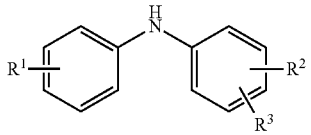

where $R^1$ is hydrogen or a hydrocarbyl group of 1 to 12 carbon atoms; $R^2$ and $R^3$ are independently hydrogen or hydrocarbyl groups of 1 to 12 carbon atoms or $R^2$ and $R^3$ taken together may form a saturated or unsaturated hydrocarbyl ring containing 5 or 6 carbon atoms. In one embodiment at least one of $R^1$, $R^2$, and $R^3$ is an alkyl group of 6 to 12 carbon atoms, or 8 carbon atoms, or 9 carbon atoms.

In certain embodiments, the aromatic basic amine compound may be represented by the formula

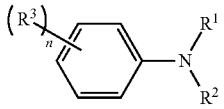

where $R^1$ and $R^2$ are independently hydrogen, linear or branched hydrocarbyl groups of 1 to 18 carbon atoms, (poly)alkoxylate groups such as —($CHR_4$ $CHR_4$—O—)$_m$—H where m is an integer from 1 to 12 and each $R^4$ is independently hydrogen or a hydrocarbyl group of 1 to 4 carbon atoms, mixtures thereof, or taken together form 5- or 6-membered rings; n is an integer from 0 to 3; $R^3$ is a linear or branched hydrocarbyl group of 1 to 18 carbon atoms, —$OR^5$, —C(O)X$R^6$, —$NR^1R^2$, or mixtures thereof; $R^5$ is a linear or branched hydrocarbyl group of 1 to 12 carbon atoms; X is oxygen (—O—), sulfur (—S—) or —NR'—; $R^6$ is a linear or branched hydrocarbyl group of 1 to 24 carbon atoms; and $R^7$ is hydrogen or a hydrocarbyl group of 1 to 24 carbon atoms.

The aromatic basic amine may be represented by the formula

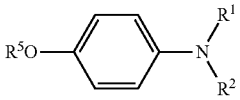

where $R^1$ and $R^2$ are independently hydrogen, linear or branched hydrocarbyl groups of 1 to 18 carbon atoms, (poly)alkoxylate groups such as —($CHR_4$ $CHR_4$—O—)$_m$—H where m is an integer from 1 to 12 and each $R^4$ is independently hydrogen or a hydrocarbyl group of 1 to 4 carbon atoms, mixtures thereof, or taken together form 5- or 6-membered rings; and $R^5$ is a linear or branched hydrocarbyl group of 1 to 12 carbon atoms. Examples of aromatic amines represented by the formula include N,N-dihexyl-p-phenetidine, N,N-di(2-ethylhexyl)-p-phenetidine, and p-anisidine, N,N-di(2-ethylhexyl)-p-anisidine.

The aromatic basic amine may be represented by the formula

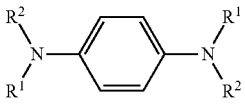

where $R^1$ and $R^2$ are independently hydrogen, linear or branched hydrocarbyl groups of 1 to 18 carbon atoms, (poly)alkoxylate groups such as —$(CHR^4CHR^4—O—)_m$—H where m is an integer from 1 to 12 and each $R^4$ is independently hydrogen or a hydrocarbyl group of 1 to 4 carbon atoms, mixtures thereof, or taken together form 5- or 6-membered rings. Examples of basic aromatic amines that may be represented by the formula above include p-phenylenediamine, N-phenyl-p-phenylene diamine, and N-alkyl-N'-phenyl phenylene diamine where the alkyl group is a mixture of C6 and C7 alkyl chains.

In certain embodiments, the aromatic basic amine compound may be a pyridine or substituted pyridine compound. The pyridine compound may be represented by the formula

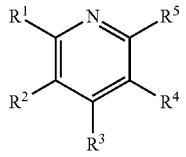

where $R^1$, $R^2$, $R^3$, $R^4$, and $R^5$ are independently hydrogen, hydrocarbyl groups of 1 to 24 carbon atoms, or —C(═O)$XR^6$ where X may be oxygen (—O—), sulfur (—S—), or nitrogen (—$NR^7$—) and $R^6$ and $R^7$ are linear or branched hydrocarbyl groups of 1 to 24 carbon atoms or (poly) alkoxylate groups such as —$(CHR^8CHR^8O)_m$—H where m is an integer from 1 to 12.

In one embodiment, the pyridine compound may be substituted with one or more acyl groups; these acyl groups may take the form of ester, thioester, or amide groups. Acylated pyridine compounds may be represented by the formula

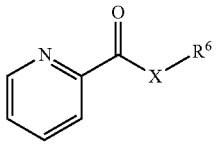

where X may be oxygen (—O—), sulfur (—S—), or nitrogen (—$NR^7$—); and $R^6$ and $R^7$ are linear or branched hydrocarbyl groups of 1 to 24 carbon atoms, hydrocarbyl groups of 4 to 18 carbon atoms, hydrocarbyl groups of 6 to 15 carbon atoms, or (poly)alkoxylate groups such as —$(CHR^8CHR^8O)_m$—H and where m is an integer from 1 to 12. In one embodiment, the acylated pyridine compound may have two or more acyl groups. Pyridine compounds substituted with two or more acyl groups may be represented by the formulas

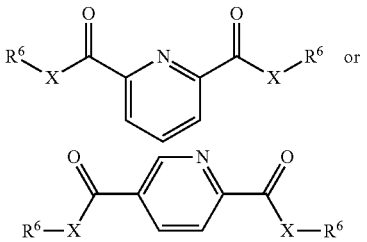

where X may be oxygen (—O—), sulfur (—S—), or nitrogen (—NR'—); and $R^6$ and $R^7$ are linear or branched hydrocarbyl groups of 1 to 24 carbon atoms, hydrocarbyl groups of 4 to 18 carbon atoms, hydrocarbyl groups of 6 to 15 carbon atoms, or (poly)alkoxylate groups such as —$(CHR^8CHR^8O)_m$—H and where m is an integer from 1 to 12.

The amount of the basic amine compound in a lubricating composition may be 0.3 wt % to 5 wt % (or 0.8 wt % to 4 wt %, or 1 wt % to 3 wt %). The material may also be present in a concentrate, alone or with other additives and with a lesser amount of oil. In a concentrate, the amount of material may be two to ten times the above concentration amounts. In a lubricating composition, the amount may be suitable to provide at least 0.3, 0.5, 0.7, or 1.0 TBN to the lubricating composition, and in some embodiments up to 5 or 4 or 3 TBN. For example the basic amine compound may deliver to the lubricating composition 0.3 to 5, or 0.5 to 4, or 0.7 to 3, or 1 to 3 TBN.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the disclosed technology lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity comprises an API Group I, Group II, Group III, Group IV, Group V oil or mixtures thereof.

Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

The amount of the oil of lubricating viscosity present is typically the balance remaining after subtracting from 100 wt % the sum of the amount of the additive as described herein above, and the other performance additives.

The lubricating composition may be in the form of a concentrate and/or a fully formulated lubricant. If the lubricating composition of the disclosed technology is in the form of a concentrate (which may be combined with additional oil to form, in whole or in part, a finished lubricant), the ratio of the of components of the disclosed technology to the oil of lubricating viscosity and/or to diluent oil include the ranges of 1:99 to 99:1 by weight, or 80:20 to 10:90 by weight.

Other Performance Additives

A lubricating composition may be prepared by adding the product of the process described herein to an oil of lubricating viscosity, optionally in the presence of other performance additives (as described herein below).

The lubricating composition of the disclosed technology optionally comprises other performance additives. The other performance additives include at least one of metal deactivators, viscosity modifiers, detergents, friction modifiers, antiwear agents, corrosion inhibitors, dispersants, extreme pressure agents, antioxidants, foam inhibitors, demulsifiers, pour point depressants, seal swelling agents (different from those of the disclosed technology) and mixtures thereof. Typically, fully-formulated lubricating oil will contain one or more of these performance additives.

In one embodiment the disclosed technology provides a lubricating composition further comprising an overbased metal-containing detergent or mixture thereof.

Overbased detergents are known in the art. Overbased materials, otherwise referred to as overbased or superbased salts, are generally single phase, homogeneous systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, typically carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Third Edition, Edited by R. M. Mortier and S. T. Orszulik, Copyright 2010, page 219, sub-heading 7.25.

The overbased metal-containing detergent may be chosen from non-sulfur-containing phenates, sulfur-containing phenates, sulfonates, salixarates, salicylates, carboxylates, and mixtures thereof, or borated equivalents thereof. The overbased detergent may be borated with a borating agent such as boric acid.

The overbased detergent may be non-sulfur containing phenates, sulfur containing phenates, sulfonates, or mixtures thereof.

The lubricant may further comprise an overbased sulfonate detergent present at 0.01 wt % to 0.9 wt %, or 0.05 wt % to 0.8 wt %, or 0.1 wt % to 0.7 wt %, or 0.2 wt % to 0.6 wt %.

The overbased sulfonate detergent may have a metal ratio of 12 to less than 20, or 12 to 18, or 20 to 30, or 22 to 25.

The lubricant composition may also include one or more detergents in addition to the overbased sulfonate.

Overbased sulfonates typically have a total base number of 250 to 600, or 300 to 500 (on an oil free basis). Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005/065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulfonate detergent may be particularly useful for assisting in improving fuel economy. In one embodiment the sulfonate detergent may be a metal salt of one or more oil-soluble alkyl toluene sulfonate compounds as disclosed in paragraphs [0046] to [0053] of US Patent Application 2008/0119378.

In one embodiment the overbased sulfonate detergent comprises an overbased calcium sulfonate. The calcium sulfonate detergent may have a metal ratio of 18 to 40 and a TBN of 300 to 500, or 325 to 425.

The other detergents may have a metal of the metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

The other detergent may have an alkali metal, an alkaline earth metal, or zinc counter ion. In one embodiment the metal may be sodium, calcium, barium, or magnesium. Typically other detergent may be sodium, calcium, or magnesium containing detergent (typically, calcium, or magnesium containing detergent).

The other detergent may typically be an overbased detergent of sodium, calcium or magnesium salt of the phenates, sulfur-containing phenates, salixarates and salicylates. Overbased phenates and salicylates typically have a total base number of 180 to 450 TBN (on an oil free basis).

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP.

The overbased detergent may be present at 0 wt % to 10 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricant composition. For a passenger car engine the detergent may be present at 0.2 wt % to 1 wt % of the lubricant composition. In one embodiment, an engine lubricant composition comprises at least one overbased detergent with a metal ratio of at least 3, or at least 8, or at least 15.

The lubricating composition in a further embodiment comprises an antioxidant, wherein the antioxidant comprises a phenolic or an aminic antioxidant or mixtures thereof.

The antioxidants include diarylamines, alkylated diarylamines, hindered phenols, or mixtures thereof. When present the antioxidant is present at 0.1 wt % to 3 wt %, or 0.5 wt % to 2.75 wt %, or 1 wt % to 2.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In another embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4 propyl-2,6-di-tert-butylphenol or 4-butyl-2,6-di-tert-butylphenol, or 4-dodecyl-2,6-di-tert-butyhphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

The lubricating composition may in a further embodiment include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetraethylene-pentamine, pentaethylene-hexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and a polyamine as described above.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

When present, the dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition.

In one embodiment the lubricating composition disclosed herein further comprises an ashless dispersant comprising a succinimide dispersant selected from one of the succinimide dispersants disclosed previously, wherein the succinimide dispersant has a TBN of at least 40 mg KOH/g, and said dispersant is present at 1.2 wt % to 5 wt %, or 1.8 wt % to 4.5 wt % of the lubricating composition.

The succinimide dispersant may comprise a polyisobutylene succinimide, wherein the polyisobutylene from which polyisobutylene succinimide is derived has a number average molecular weight of 350 to 5000, or 750 to 2500.

In one embodiment the friction modifier may be chosen from long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurised fatty compounds and olefins, molybdenum dialkyldithiophosphates, molybdenum dithiocarbamates, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis (S-alkyldithiocarbamyl) disulfides. The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2 ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In a further embodiment the titanium (IV) carboxylate is titanium neodecanoate.

The lubricating composition may in one embodiment further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Extreme Pressure (EP) agents that are soluble in the oil include sulfur- and chlorosulfur-containing EP agents, dimercaptothiadiazole or CS2 derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be useful in the lubricating compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Viscosity improvers (also sometimes referred to as viscosity index improvers or viscosity modifiers) may be included in the compositions of this disclosed technology. Viscosity improvers are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP). PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants. In certain embodiments, the viscosity index improver is a polyolefin comprising ethylene and one or more higher olefin, preferably propylene. Polymeric viscosity modifiers may be present in a lubricating composition from 0.1 to 10 wt %, or 0.3 wt % to 5 wt %, or 0.5 wt % to 2.5 wt %.

Pour point depressants that may be useful in the lubricating compositions of the disclosed technology include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1, 2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

An engine lubricating composition in different embodiments may have a composition as disclosed in the following table:

| | Embodiments (wt %) | | |
|---|---|---|---|
| Additive | A | B | C |
| Dioxane-Dione | 0.05 to 10 | 0.2 to 5 | 0.5 to 2 |
| Basic Amine Compound | 0.3 to 5 | 0.8 to 4 | 1 to 3 |
| Corrosion Inhibitor | 0.05 to 2 | 0.1 to 1 | 0.2 to 0.5 |
| Overbased Detergent | 2 to 9 | 3 to 8 | 3 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | | |

The lubricating composition may further comprise:

0.01 wt % to 5 wt % of a 1,3-dioxane-4,6-dione compound; and 0.1 wt % to 10 wt % of a basic amine compound, 0.1 wt % to 6 wt %, or 0.4 wt % to 3 wt % of an overbased detergent chosen from a calcium or magnesium non-sulfur containing phenate, a calcium or magnesium a sulfur containing phenate, or a calcium or magnesium sulfonate, and 0.5 wt % to 10 wt %, or 1.2 wt % to 6 wt % a polyisobutylene succinimide, wherein the polyisobutylene of the polyisobutylene succinimide has a number average molecular weight of 550 to 3000, or 1550 to 2550, or 1950 to 2250.

The lubricating composition may further comprise:

0.5 wt % to 2 wt % of a 1,3-dioxane-4,6-dione compound; and 1 wt % to 3 wt % of a basic amine compound, 0.1 wt % to 6 wt %, or 0.4 wt % to 3 wt % of an overbased detergent chosen from a calcium or magnesium non-sulfur containing phenate, a calcium or magnesium a sulfur containing phenate, or a calcium or magnesium sulfonate, and 0.5 wt % to 10 wt %, or 1.2 wt % to 6 wt % a polyisobutylene succinimide, wherein the polyisobutylene of the polyisobutylene succinimide has a number average molecular weight of 550 to 3000, or 1550 to 2550, or 1950 to 2250, and zinc dialkyldithiophosphate present in an amount to deliver 0 ppm to 900 ppm, or 100 ppm to 800 ppm, or 200 to 500 ppm of phosphorus.

Typically the basic amine compound may be a diarylamine, or mixtures thereof such as di-nonylated diphenylamine, or nonyl diphenylamine.

INDUSTRIAL APPLICATION

In one embodiment the disclosed technology provides a method of lubricating an internal combustion engine. The engine components may have a surface of steel or aluminum.

An aluminum surface may be derived from an aluminum alloy that may be a eutectic or a hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an exhaust gas recirculation system. The internal combustion engine may be fitted with an emission control system or a turbocharger. Examples of the emission control system include diesel particulate filters (DPF), Gasoline Particulate Filters (GPF), Three-Way Catalyst (TWC) or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine. In one embodiment the internal combustion engine may be a gasoline engine such as a gasoline direct injection engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine). In one embodiment the internal combustion engine is a 4-stroke engine.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.2 wt % or 1.1 wt % of the lubricant composition. In one embodiment the sulfated ash content may be 0.5 wt % to 1.2 wt % of the lubricant composition.

In one embodiment the lubricant composition may be an engine oil, wherein the lubricant composition may be characterized as having at least one of (i) a sulfur content of 0.5 wt % or less, (ii) a phosphorus content of 0.12 wt % or less, and (iii) a sulfated ash content of 0.5 wt % to 1.1 wt % of the lubricant composition.

The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less.

The lubricating composition may be characterized as having a sulfated ash content of 0.5 wt % to 1.2 wt %.

The lubricating composition may be characterized as having a total base number (TBN) content of at least 5 mg KOH/g.

The lubricating composition may be characterized as having a total base number (TBN) content of 6 to 13 mg KOH/g, or 7 to 12 mg KOH/g.

The lubricating composition may have a SAE viscosity grade of XW—Y, wherein X may be 0, 5, 10, or 15; and Y may be 16, 20, 30, or 40.

The internal combustion engine disclosed herein may be a 2-stroke marine diesel engine, and the disclosed technology may include a method of lubricating a marine diesel cylinder liner of a 2-stroke marine diesel engine.

The internal combustion engine may have a surface of steel, or an aluminum alloy, or an aluminum composite. The internal combustion engine may be an aluminum block engine where the internal surface of the cylinder bores has been thermally coated with iron, such as by a plasma transferred wire arc (PTWA) thermal spraying process. Thermally coated iron surfaces may be subjected to conditioning to provide ultra-fine surfaces.

Typically the vehicle powered by the compression-ignition internal combustion engine of the disclosed technology has a maximum laden mass over 3,500 kg.

EXAMPLES

The following examples provide illustrations of the disclosed technology. These examples are non-exhaustive and are not intended to limit the scope of the disclosed technology.

A series of engine lubricating compositions in Group II base oil of lubricating viscosity are prepared containing the dioxane dione of the disclosed technology and one or more basic amine compounds as well as conventional additives including polymeric viscosity modifier, overbased detergents different from that of the disclosed technology, antioxidants (combination of phenolic ester, and sulfurized olefin), zinc dialkyldithiophosphate (ZDDP), as well as other performance additives as follows (Table 1)

TABLE 1

| | Lubricating compositions[1] | | | | | | |
|---|---|---|---|---|---|---|---|
| | OIL1 | OIL2 | OIL3 | OIL4 | OIL5 | OIL6 | OIL7 |
| Group II Base Oil | Balance to 100% | | | | | | |
| 2,2-dimethyl-1,3-dioxane-4,6-dione | 0 | 0.5 | 1.0 | 1.5 | 1 | 1 | 1 |
| Basic diarylamine[2] | 0.15 | 0.15 | 0.15 | 0.15 | 0.15 | 0.15 | 0.15 |
| Basic nitrogen dispersant[3] | 4.1 | 4.1 | 4.1 | 4.1 | 4.1 | 4.1 | 4.1 |
| Decylanthranilate (TBN = 190) | 0 | 0 | 0 | 0 | 0.5 | 0 | 0 |
| p-Phenetidine (TBN = 400) | 0 | 0 | 0 | 0 | 0 | 0.5 | 0 |
| Bis(2-ethylhexyl) amine (TBN = 225) | 0 | 0 | 0 | 0 | 0 | 0 | 0.4 |
| Sulfonate[4] | 0.89 | 0.89 | 0.89 | 0.89 | 0.89 | 0.89 | 0.89 |
| ZDDP[5] | 0.98 | 0.98 | 0.98 | 0.98 | 0.98 | 0.98 | 0.98 |
| Antioxidant[6] | 1.36 | 1.36 | 1.36 | 1.36 | 1.36 | 1.36 | 1.36 |
| Phenate Detergent | 0.8 | 0.8 | 0.8 | 0.8 | 0.8 | 0.8 | 0.8 |
| DVM Soot booster | 0.66 | 0.66 | 0.66 | 0.66 | 0.66 | 0.66 | 0.66 |
| Viscosity Modifier[7] | 0.56 | 0.56 | 0.56 | 0.56 | 0.56 | 0.56 | 0.56 |
| Additional additives[8] | 1.16 | 1.16 | 1.16 | 1.16 | 1.16 | 1.16 | 1.16 |

[1]All treat rates on an oil-free basis
[2]Nonylated diphenylamine (TBN = 150)
[3]Succinimide dispersant derived from succinated polyisobutylene (Mn 2000) (TBN = 57)
[4]Overbased calcium sulfonate detergents
[5]Secondary ZDDP derived from mixture of C3 and C6 alcohols
[6]Mixture of sulfurized olefin and hindered phenol
[7]Ethylene-propylene copolymer with Mn of 90,000
[8]Additional additives include surfactant, corrosion inhibitor, anti-foam agents, friction modifiers, and pourpoint depressants The lubricating compositions are evaluated for cleanliness, i.e. the ability to prevent or reduce deposit formation; fluorelastomer seals compatibility; and corrosion resistance.

Deposit control is measured by the Komatsu Hot Tube (KHT) test, which employs heated glass tubes through which sample lubricating composition is pumped, approximately 5 mL total sample, typically at 0.31 mL/hour for an extended period of time, such as 16 hours, with an air flow of 10 mL/minute. The glass tube is rated at the end of test for deposits on a scale of 0 (very heavy varnish) to 10 (no varnish).

In the Panel Coker deposit test, the sample, at 105° C., is splashed for 4 hours on an aluminum panel maintained at 325° C. The aluminum plates are analyzed using image analysis techniques to obtain a universal rating. The rating score is based on "100" being a clean plate and "0" being a plate wholly covered in deposit.

The lubricating oil compositions summarized in Table 1 above are tested for seals performance using a standard seals compatibility test. In the test, a sample of fluoroelastomeric seal material is exposed to the lubricating oil composition for a period of time at elevated temperatures. The seal material is tested both before and after the exposure to determine any impact the exposure had on its physical properties, particularly those related to good seal performance and durability. Specifically, the tensile strength and rupture elongation strength of the seal material is measured before and after the exposure. A larger absolute % change in either of these quantities is an indication of greater seal material degradation and so worse performance. In other words, the smaller the change, the less seal degradation that has occurred, and so the more compatible the material is with the seal material. All samples are also tested to determine TBN, using ASTM procedure D2896 and ASTM D4739, and their sulfated ash levels, using ASTM procedure D874. All testing is performed with Viton® seal material and the results are summarized in Table 2 below.

The lubricating oil compositions summarized in Table 1 above are tested for the tendency to corrode various metals, specifically alloys of lead and copper (commonly used in cam followers and bearings). This is accomplished with the ASTM D6594-14 corrosion bench test.

TABLE 2

| Seals Compatibility Testing | | | | |
|---|---|---|---|---|
| | OIL1 | OIL2 | OIL3 | OIL4 |
| Sulfated Ash (D874) | 0.96 | 0.96 | 0.96 | 0.96 |
| TBN (D2896) | 8.6 | 8.5 | 8.4 | 8.2 |
| TBN (D4739) | 7.3 | 7.8 | 8.1 | 8.1 |
| DBL6674_FKM | | | | |
| Tensile Strength Change (%) | −50.8 | −22.6 | −15 | −15.3 |
| Rupture Elongation Change (%) | −44 | −23 | −12.8 | −11.5 |

The data above shows that addition of the dioxane dione compound to formulations containing basic nitrogen additives that deliver TBN to the lubricating composition results in improved seals performance without a decrease in measured TBN levels. The results indicate that there is no discernible reaction between the dioxane dione compound and the basic amine compounds in the lubricating composition.

It is known that some of the materials described above may interact in the final formulation, so that the components of the final formulation may be different from those that are initially added. The products formed thereby, including the products formed upon employing lubricating composition of the disclosed technology in its intended use, may not be susceptible of easy description. Nevertheless, all such modifications and reaction products are included within the scope of the disclosed technology; the disclosed technology encompasses lubricating composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the disclosed technology may be used together with ranges or amounts for any of the other elements.

While the disclosed technology has been explained in relation to its preferred embodiments, it is to be understood that various modifications thereof will become apparent to those skilled in the art upon reading the specification. Therefore, it is to be understood that the disclosed technology disclosed herein is intended to cover such modifications as fall within the scope of the appended claims.

What is claimed:

1. A lubricating composition comprising (a) an oil of lubricating viscosity; (b) 0.01 wt % to 5 wt % of a 1,3-dioxane-4,6-dione compound; and (c) 0.1 wt % to 10 wt % of a basic amine compound selected from one or more of a phenylene diamine, a diarylamine, a pyridine, and a substituted pyridine compound.

2. The lubricating composition of claim 1, wherein the basic amine compound has a molecular weight of less than 1000 g $mol^{-1}$.

3. The lubricating composition of claim 1, wherein the basic amine compound comprises a diarylamine.

4. The lubricating composition of claim 1, wherein the basic amine compound comprises a phenylene diamine.

5. The lubricating composition of claim 1, wherein the basic amine compound comprises at least one of a pyridine or substituted pyridine compound.

6. The lubricating composition of claim 1, wherein the basic amine compound comprises an N-hydrocarbyl substituted aminoester compound.

7. The lubricating composition of claim 1, wherein the basic amine compound comprises a polyisobutylene succinimide dispersant.

8. The lubricating composition of claim 1, wherein the basic amine compound is present at 0.3 wt % to 5 wt %; and the 1,3-dioxane-4,6-dione compound is present at 0.3 wt % to 4 wt %.

9. The lubricating composition of claim 1, further comprising a zinc dialkyldithiophosphate.

10. The lubricating composition of claim 9, further comprising a polyisobutylene succinimide dispersant.

11. The lubricating composition of claim 1, further comprising an overbased metal-containing detergent, or mixtures thereof.

12. The lubricating composition of claim 11, wherein the overbased metal-containing detergent is chosen from non-sulfur-containing phenates, sulfur-containing phenates, sulfonates, salixarates, salicylates, carboxylates, and mixtures thereof, or borated equivalents thereof.

13. The lubricating composition of any claim 12, wherein the overbased detergent is present 0.1 wt % to 10 wt %.

14. The lubricating composition of claim 1, wherein the 1,3-dioxane-4,6-dione compound is represented by the formula

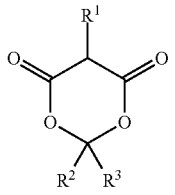

wherein $R^1$ is selected from hydrogen or a hydrocarbyl group of 1 to 4 carbon atoms; and $R^2$ and $R^3$ are independently hydrogen or a hydrocarbyl group of 1 to 4 carbon atoms.

15. The lubricating composition of claim 14, wherein $R^1$ is hydrogen and each of $R^2$ and $R^3$ are hydrocarbyl groups of 1 carbon atom.

16. A lubricating composition comprising:

0.01 wt % to 5 wt % of a 1,3-dioxane-4,6-dione compound;

0.1 wt % to 10 wt % of a basic amine compound selected from one or more of a phenylene diamine, a diarylamine, a pyridine, and a substituted pyridine compound;

0.1 wt % to 6 wt %, of an overbased detergent selected from a calcium or magnesium non-sulfur containing phenate, a calcium or magnesium a sulfur containing phenate, or a calcium or magnesium sulfonate; and 0.5 wt % to 10 wt %, of a polyisobutylene succinimide, wherein the polyisobutylene of the polyisobutylene succinimide has a number average molecular weight of 550 to 3000.

17. The lubricating composition of claim 16 comprising:

0.5 wt % to 2 wt % of a 1,3-dioxane-4,6-dione compound; and 1 wt % to 3 wt % of a basic amine compound, 0.1 wt % to 6 wt % of an overbased detergent selected from a calcium or magnesium non-sulfur containing phenate, a calcium or magnesium a sulfur containing phenate, or a calcium or magnesium sulfonate, and 0.5 wt % to 10 wt % of a polyisobutylene succinimide, wherein the polyisobutylene of the polyisobutylene succinimide has a number average molecular weight of 550 to 3000, and zinc dialkyldithiophosphate present in an amount to deliver 100 ppm to 800 ppm of phosphorus.

18. A method of lubricating an internal combustion engine comprising supplying to the internal combustion engine a lubricating composition comprising (a) an oil of lubricating viscosity; (b) 0.01 wt % to 5 wt % of a 1,3-dioxane-4,6-dione compound; and (c) 0.1 wt % to 10 wt % of a basic amine compound.

* * * * *